United States Patent [19]

Ignell et al.

[11] 3,999,678

[45] Dec. 28, 1976

[54] CLOSING ARRANGEMENT FOR PACKING CONTAINERS

[75] Inventors: Rolf Lennart Ignell, Lund; Ingvar Erling Nilsson, Akarp, both of Sweden

[73] Assignee: Sobrefina SA, Fribourg, Switzerland

[22] Filed: Dec. 1, 1975

[21] Appl. No.: 636,639

[52] U.S. Cl. ..... 220/269; 220/270; 220/307; 220/335; 220/339

[51] Int. Cl.[2] ..... B65D 41/32

[58] Field of Search ..... 220/335, 339, 269, 270, 220/375, 307; 222/517, 498, 543, 541; 215/306

[56] References Cited

UNITED STATES PATENTS

| | | | |
|---|---|---|---|
| 3,289,877 | 12/1966 | Wolf | 220/339 |
| 3,629,901 | 12/1971 | Wolf | 220/339 X |
| 3,741,447 | 6/1973 | Miles et al. | 220/339 X |
| 3,744,662 | 7/1973 | Zundel | 220/339 X |
| 3,933,271 | 1/1976 | McGhie | 220/339 X |

*Primary Examiner*—George T. Hall
*Attorney, Agent, or Firm*—Pierce, Scheffler & Parker

[57] ABSTRACT

A closing arrangement made of plastic material for packing containers includes a tubular part which is anchored in an opening provided in the pour opening of the container and a cap member attached to the tubular part at one side and which includes a pull ring extending from the other side. The cap member is also attached to the tubular part by means of a frangible region which is broken as the pull ring is lifted, and the cap is automatically retained in the open position to facilitate pouring of the contents from the container.

6 Claims, 12 Drawing Figures

CLOSING ARRANGEMENT FOR PACKING CONTAINERS

The present invention relates to a closing arrangement for packing containers, which arrangement comprises a tubular part that can be firmly anchored in the pouring opening of the container, and a cap provided with pull-ring which closes this tubular part.

The closing arrangements of this type are manufactured from polyethylene and are used for the closing of thin-walled packing containers, e.g. one-way bottles made from plastics. The tubular part of the closing arrangement is pressed down into the pouring opening of the package and seals against the inner surface of the same by means of a number of sealing rings and a retaining flange. The upper end of the tubular part is joined to the cap located above the upper end of the pouring opening by means of a weakened annular region, a so-called tear-ring. When the package is to be opened, the consumer introduces a finger into the pull-ring and lifts the same upwards, so that a part of the cap, demarcated by means of a weakening line, is lifted upwards and the tear-ring is caused to break along a part of its periphery. On continued pulling upwards of the pull-ring, the tear-ring breaks completely, whereupon the cap can be wholly withdrawn from the package and from the tubular part of the closing arrangement which is firmly anchored in the pouring opening of the package.

This known closing arrangement has proved to fulfil satisfactorily the demands which are made on such an arrangement, in that it can readily be applied to the pouring opening, that it remains steadily anchored in the same, presents good tightness also at a high pressure in the packing container and is easy to open. In recent times more and more attention has been given to environmental and nature conservation aspects, and here it was found to be a disadvantage that the cap, after the opening of the package, is wholly separated from the same, since it was found that even if the consumers to an increasing degree look after one-way containers and drop the same at the place intended therefore, the small caps tend to end up in open spaces. This is of course unsuitable, even though the relatively soft caps cannot do any harm to animals or men.

One object of the present invention is to provide a closing arrangement of the type mentioned at the start, which closing arrangement is do designed that the cap which can be withdrawn from the package opening remains after opening attached to the package.

It is a further object of the present invention to design the closing arrangement in such a manner, that the cap after opening the package remains in a suitable open position and does not obstruct the pouring out of the contents of the package.

These and other objects have been achieved in accordance with the invention in that a closing arrangement of the type described in the introduction is characterized in that the cap and the tubular part are joined together by means of a first connecting element, which is adapted to be broken when the packing container is opened, and a second connecting element, which is adapted so that it keeps the cap attached to the tubular part after the opening of the package. Preferred embodiments of the closing arrangement in accordance with the invention were provided with the characteristics which are evident from the subsidiary claims.

The invention will be described in detail in the following with reference to the enclosed drawings which show schematically four different embodiments of the closing arrangement in accordance with the invention.

Figure 1:
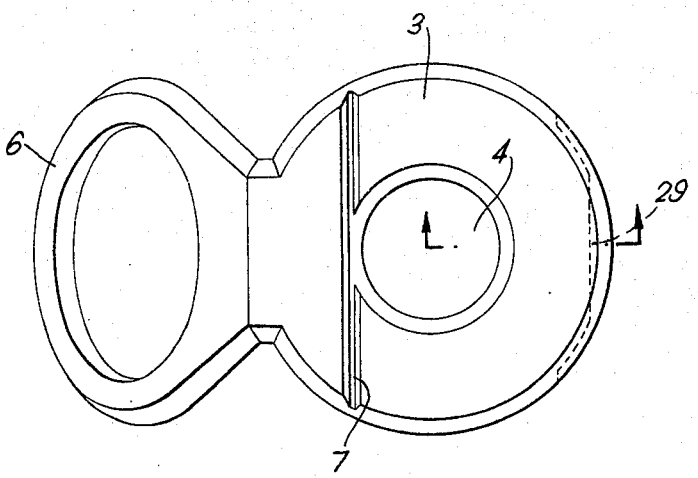
FIG. 1 shows a first embodiment of a closing arrangement in accordance with the invention in plan view.
Figure 2:
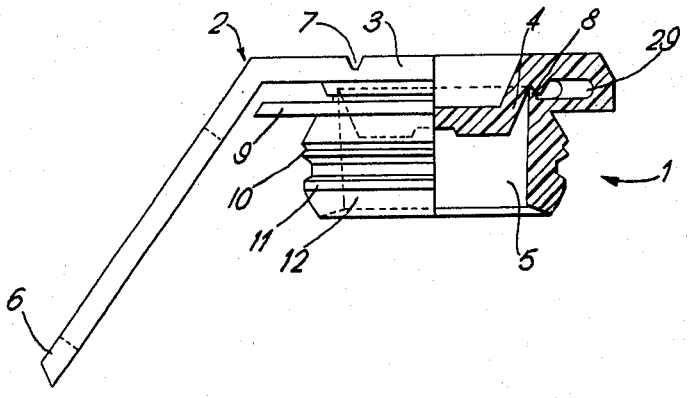
FIG. 2 shows the closing arrangement in accordance with FIG. 1 from the side and partially in section.

The various embodiments of the closing arrangement in accordance with the invention shown on the drawings all comprise a lower tubular part 1 and a cap 2 joined to the same. The cap 2 has a substantially circular flange 3 and a centrally situated recessed region 4, which extends down into the central hole 5 of the tubular part 1 (FIG. 1 and 2). The flange 3 of the cap 2 is joined at one part of its periphery to a pull-ring 6, which extends at an angle downwards from the flange 3. The cap 2 is provided furthermore with a groove 7, arranged in its upper surface, which is a tangent on the recessed region 4 and is intended to facilitate withdrawing the cap 2 when the package is to be opened, which will be described in more detail in the following. The cap 2 is joined via a weakened region on a tear-ring 8 to the upper surface of the tubular part 1. This upper surface constitutes the upper surface of a flange 9 situated at the upper end of the tubular part 1, which is parallel with the flange 3 and at a certain distance underneath the same. Underneath the flange 9 the outer surface of the tubular part 1 is provided with a number of sealing rings 10 and a retaining ring 11. The bottom end of the tubular part terminates in a conical part 12, which facilitates the introduction of the tubular part into the pouring opening of the packing container 13, the tubular part 1 assumes the position shown in FIG. 3. The pouring opening of the packing container 13 is provided with an annular "lip" 14 turned inwards, the terminal edge of which makes contact with the retaining flange 11 and locks the tubular part in the pouring opening. By virtue of the contact made between the sealing rings 10 and the lip 14 a good seal is assured between the container 13 and the tubular part 1. When the tubular part has been pressed down into the correct position in the packing container, the flange 9 will moreover be in contact with the upper edge of the packing container.

The design described above is identical for the four embodiments of the closing arrangement shown. In all embodiments of the closing arrangement moreover the flange 3 of the cap 2 and the flange 9 of the tubular part 1 are connected to one another in the peripheral region, on the right in the drawings, by means of a connecting element or a hinge, which will be described in greater detail in the following with reference to the respective figures.

All the embodiments of the closing arrangement in accordance with the invention shown further have in common that they are opened in the same manner, namely in that the pull-ring 6 is gripped and that the same is lifted. In doing this the portion of the flange 3 of the cap 2 which is situated between the groove 7 and the pull-ring 6 will be lifted upwards, whereby the region of the tear-ring 8 situated underneath the groove 7 will be broken. On continued pulling upwards of the pull-ring 6, the tear-ring 8 will break completely, whereby the cap 2 can be wholly pivoted upwards about said hinge element shown on the righthand side of the drawing, and the contents of the packing container 13 can be poured out through the central hole 5 in the tubular part 1. With the object of preventing any pivoting back of the opened cap 2 after the pivoting up, or any other kind of obstruction of the pouring out of the contents of the packing container, the hinge element has been given a special self-locking design, by virtue of which the cap is retained in the pivoted-up position. The construction of this hinge element distinguishes the different embodiments of the closing arrangement in accordance with the invention from one another, and in the following each of them will be described with special reference to the different figures.

Figure 3:
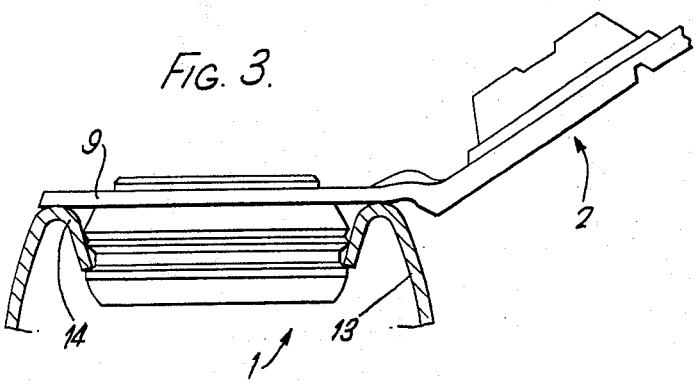
FIG. 3 shows the closing arrangement in accordance with FIG. 1 and 2 in open condition and put in place in the pouring opening of a packing container.

The embodiment of the closing arrangement shown in FIGS. 1–3 has a hinge element in the form of a crescent-shaped bridge 29, which extends between the flange 3 of the cap 2 and the flange 9 of the tubular part 1 and joins them together along a part of the periphery. The hinge element, like in all the other embodiments, is situated diametrically opposite the pull-ring 6. The outer limiting line of the bridge corresponds to the periphery of the flanges and the bridge has a length which constitutes between one-tenth and one-fourth of the peripheral length of the flanges.

When this embodiment of the closing arrangement is opened in the manner described earlier, that is to say by pivoting up of the cap 2, the central, coarser part of the bridge 29 will serve as a hinge about which the cap 2 is pivoted. Owing to the crescent-shape of the bridge 29, its two thinner ends will offer a certain resistance against the pivoting up of the cap, which will have the result, if the cap 2 is pivoted to the position shown in FIG. 3 in spite of this resistance, that the hinge 29 so to speak is turned inside out. The two thinner outer portions of the bridge 29 have in other words been forced past the central part of the bridge and thus retain the cap in open position.

A close variant of this embodiment, which is not shown however on the drawings, is obtained if, instead of using the whole of the crescent-shaped bridge 29, only its central, substantially straight portion is used as a hinge joining together the upper flange 3 and the lower flange 9, and the self-locking effect is achieved by means of elastic elements joining together the flanges at some distance on either side of the bridge, which when the cap 2 is pivoted up act in the same manner as the thinner end parts of the crescent-shaped bridge 29.

Figure 4:
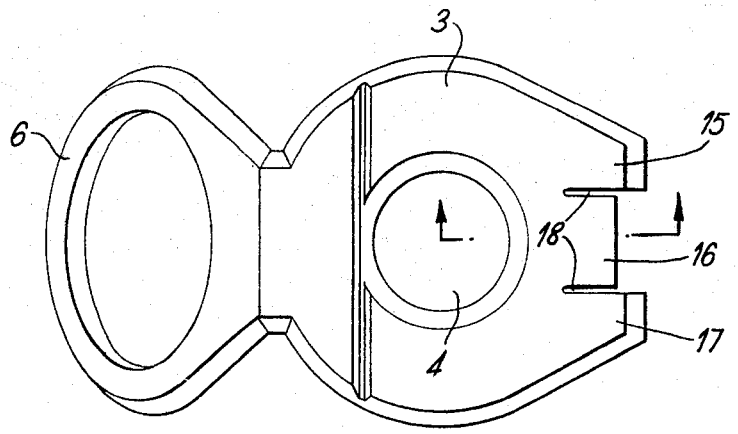
FIG. 4 shows a second embodiment of a closing arrangement in accordance with the invention in plan view.
Figure 5:
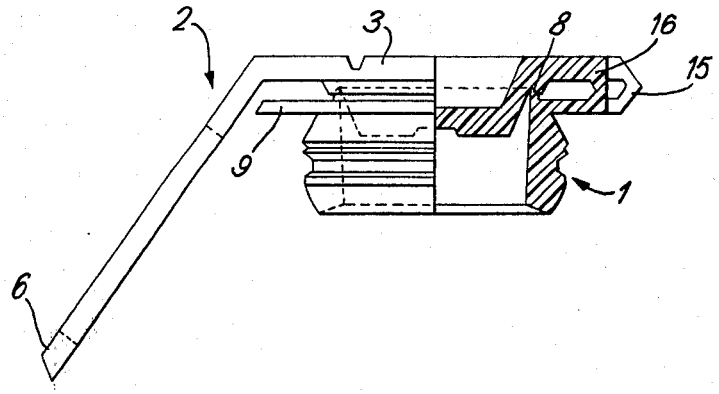
FIG. 5 shows the closing arrangement in accordance with FIG. 4 from the side and partially in section.
Figure 6:
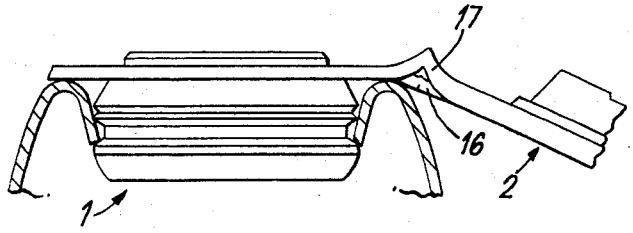
FIG. 6 shows the closing arrangement in accordance with FIG. 4 and 5 in open condition and put in place in the pouring opening of a packing container.

The embodiment of the closing arrangement which is shown in FIGS. 4–6 has on the part of the periphery of the flanges 3 and 9 which is situtated diametrically opposite the pull- or grip-ring three hinges 15, 16 and 17 situated next to one another which are separated from one another by means of two slots 18. The middle hinge 16 is situated nearer to the centre of the closing arrangement than the other two, which are situated in line with one another. Furthermore, the middle hinge 16 is in the form of a toggle-joint and has a plane outer surface (FIG. 5), which allows the straightening out of the joint, but prevents bending in the opposite direction. The outer hinges 15, 17 are of a tapered design and can be bent in both directions.

When the cap 2 is pivoted upwards, at the start, the hinges 15 and 17 as well as the toggle-joint 16, owing to the elasticity of the material, serve as hinges. When the opening angle of the cap 2 increases, the hinges can owing to the mutual displacement no longer serve as a common hinge, but the toggle-joint 16 alone assumes the role as a hinge whilst the two hinges 15 and 17 situated farther out from the centre of the closing arrangement, together with the region of the flanges 3 and 9 which is situated next to the hinges, are bent downwards until the cap 2 is fully pivoted out, when they snap upwards again to a position above the principal plane of the lower flange 9. At the same time the central toggle-joint 16, owing to its special design which can be seen from FIG. 5, will stop in a substantially straight position between the other two (FIG. 6), as a result of which the cap is retained in the fully pivoted-up position.

Figure 7:
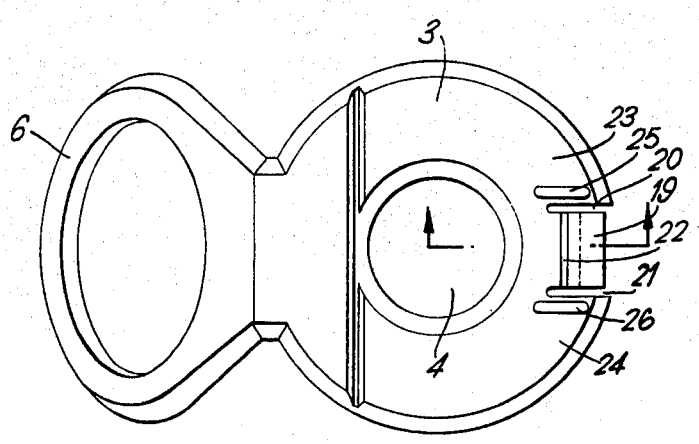
FIG. 7 shows a third embodiment of a closing arrangement in accordance with the invention in plan view.
Figure 8:
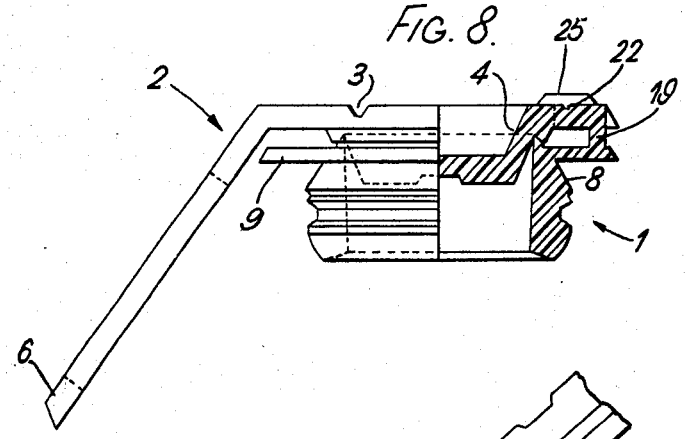
FIG. 8 shows the closing arrangement in accordance with FIG. 7 from the side and partially in section.
Figure 9:
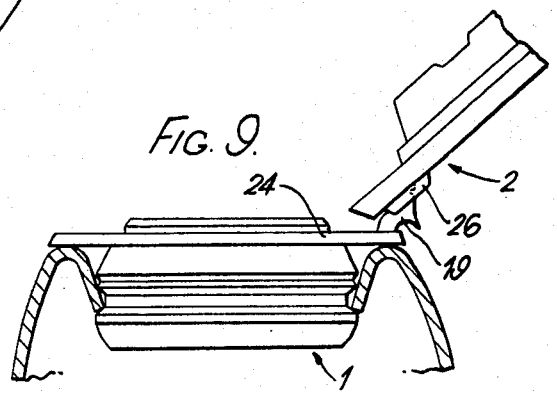
FIG. 9 shows the closing arrangement in accordance with FIG. 7 and 8 in open condition and put in place in the pouring opening of a packing container.
Figure 10:
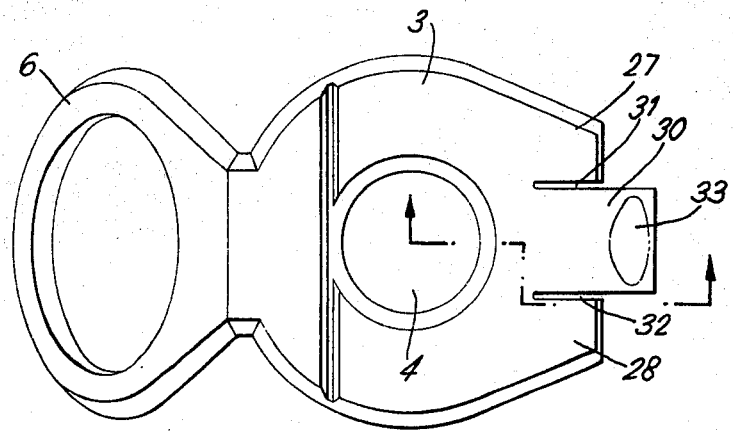
FIG. 10 shows a fourth embodiment of a closing arrangement in accordance with the invention in plan view.
Figure 11:
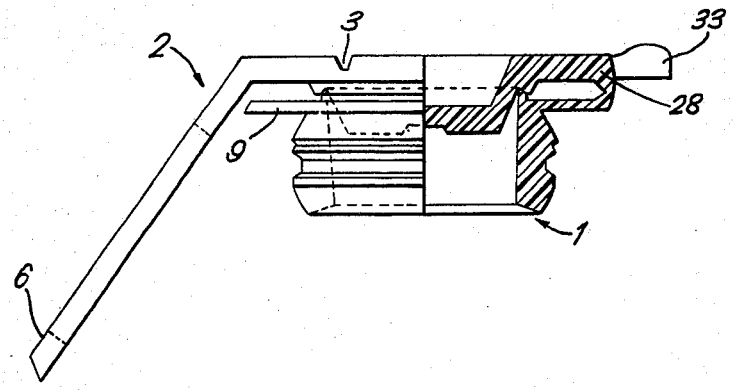
FIG. 11 shows the closing arrangement in accordance with FIG. 10 from the side and partially in section.

The embodiment of the closing device shown in FIGS. 7–9 comprises a bridge 19 joining the periheries of the upper flange 3 and of the lower flange 9. The bridge is located diametrically opposite the pull-ring and is limited at the ends by slots 20, 21 extending substantially towards the centre of the closing arrangement and cutting through at least the upper flange 3. The slots 20, 21 extend substantially halfway in towards the centre 4 of the cap 2, and are joined at their inner ends by means of a groove 22 running parallel with the bridge 19 and arranged in the surface of the flange 3. The parts or tongues 23, 24 of the upper flange 3 on both sides of the bridge and separated from the bridge portion by means of slots 20, 21 are stiffened by means of springs 25, 26 which extend parallel with the slots 20, 21 and at some distance from the same.

When the cap 2, after rupture of the first connecting element or tear-ring 8, is pivoted upwards, the bridge region serves as a hinge. More precisely, on pivoting the cap 2 upwards the bridge region is lifted up a little, while the hinge between the cap 2 and the bridge part largely coincides with the groove 22. Through this the outer ends of the tongues 23, 24 of the upper flange 3 situated on both sides of the bridge portion are able, while sliding towards the underlying parts of the flange 9, to pivot or snap past the hinge to a position between the bridge portion and the central hole of the tubular part 1, so that the cap 2 is locked in the open position.

A further embodiment of the closing arrangement in accordance with the invention is shown in FIGS.

10–12. In this embodiment two hinges 27, 28 are arranged at some distance from one another, but with a common centre-axis. Each hinge has the form of a bridge which connects an area on the periphery of the upper flange 3 with the corresponding area at the periphery of the lower flange 9. Between the hinges the upper flange 3 is designed as a projecting tongue 30, which is separated from the hinges by means of slots 31 and 32 and extends substantially outside the hinges, that is to say away from the centre of the closing device. The outer end of the tongue 30 is cut off in a substantially straight line and the tongue is provided furthermore at the outer end with a bulge 33 directed upwards. In the part of the lower flange 9, which is situated underneath the tongue 30, an opening (not shown on the drawing) with a somewhat greater width than the tongue is provided, which opening extends from the periphery of the lower flange 9 in the direction towards the centre of the closing arrangement and ends substantially flush with the inner end of the slots 31, 32.

Figure 12:
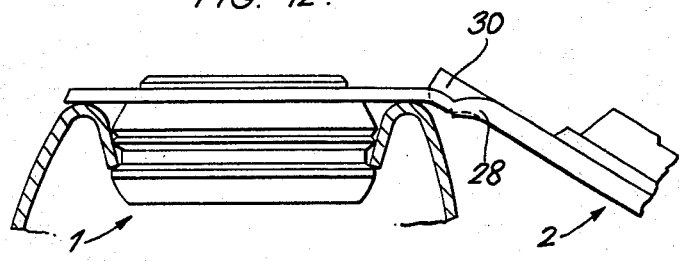
FIG. 12 shows the closing arrangement in accordance with FIG. 10 and 11 in open condition and put in place in the pouring opening of a packing container.

When the cap 2 is pivoted upwards about the hinges 27, 28 the outer end of the tongue 30 will at a certain instant come to rest against the outside of the neck of the packing container 13. On continued pivoting of the cap 2, the two hinges 27, 28 will owing to the elasticity in the material be stretched, whereby the bulge 33 of the tongue 30 will slide upwards along the outside of the packing container 13 towards a position in the opening of the flange 9 between the hinges 27, 28 in which position the cap is locked in fully opened position (FIG. 12).

It is a common feature of all the embodiments of the closing arrangement in accordance with the invention described that the mutual proportions and dimensions are adapted according to the type of plastics from which the closing arrangement is manufactured. By such an adaptation the magnitude of the locking force as well as the angle of the cap situated in locked position to the tubular part fixed in the pouring opening can be varied. It is possible of course within the scope of the following patent claims to vary and to combine the different embodiments so as to adapt them to different packing containers and material.

By means of the invention a closing arrangement is thus provided, which not only fulfills all the previously made demands on such a closing arrangement, but which also has the characteristic that it remains in one piece with the packing container after opening, which is an advantage not offered by the previously known closing arrangements.

We claim:

1. A closure device composed of a flexible plastic material for containers having an upper neck portion provided with a pouring opening, said closure device being integrally formed and comprising a tubular portion for locking engagement within the neck of the container, an outwardly extending flange surrounding the upper part of said tubular portion, a cap portion disposed within said tubular portion and provided with an outwardly extending flange about the upper part thereof and above the flange of said tubular portion, the periphery of said cap portion and the inner upper edge of said tubular portion being connected by a tear ring portion, a pull ring extending outwardly from the flange of said cap at one side thereof, a first hinge portion diametrically opposed to said pull ring and connecting the periphery of the flange of said cap portion to the periphery of the flange of said tubular element, the axis of the hinge line of said first hinge portion being at right angles to the line of pull for raising said pull ring, a pair of second hinge portions connecting the peripheries of the flanges and disposed on opposed sides of said first hinge portion, said second hinge portions having a common coaxial hinge line displaced laterally from and parallel to the axis of the hinge line of said first hinge portion, whereby when said pull ring is raised to sever said tear ring to withdraw said cap portion from said tubular portion about the axis of said first hinge portion, said second hinge portions are deformed so as to prevent said cap portion, after opening the container, from returning to its substantially closed position.

2. A closure device as claimed in claim 1 wherein the common coaxial hinge line of said second hinge portions is located outwardly of the axis of the hinge line of said first hinge portion.

3. A closure device as claimed in claim 1 wherein the common coaxial hinge line of said second hinge portions is located inwardly of the axis of the hinge line of said first hinge portion.

4. A closure device as claimed in claim 3 wherein said first hinge portion and said second hinge portions comprise a crescent-shaped connection between the peripheries of the flanges, the central part of said crescent-shaped connection being thicker than the end portions thereof and constituting said first hinge portion, said end portions of the crescent-shaped connection constituting said second hinge portions and the common coaxial hinge line thereof being located inwardly of the axis of the hinge line of said central part of said crescent-shaped connection.

5. A closure device as claimed in claim 4 wherein said crescent-shaped connection extends along one-tenth to one-fourth of the periphery of said flanges.

6. A closure device as claimed in claim 1 wherein the flexible plastic material comprises polyethylene.

* * * * *